US007432219B2

(12) United States Patent
Strandqvist et al.

(10) Patent No.: US 7,432,219 B2
(45) Date of Patent: Oct. 7, 2008

(54) HYDROENTANGLED NONWOVEN MATERIAL

(75) Inventors: Mikael Strandqvist, Lindome (SE); Anders Stralin, Torslanda (SE); Lars Fingal, Gothenburg (SE); Hannu Ahoniemi, Landvetter (SE)

(73) Assignee: SCA Hygiene Products AB, Gothenburg (SE)

( * ) Notice: Subject to any disclaimer, the term of this patent is extended or adjusted under 35 U.S.C. 154(b) by 147 days.

(21) Appl. No.: 10/976,884

(22) Filed: Nov. 1, 2004

(65) Prior Publication Data

US 2005/0112980 A1 May 26, 2005

Related U.S. Application Data

(60) Provisional application No. 60/515,639, filed on Oct. 31, 2003.

(51) Int. Cl.
*D04H 5/02* (2006.01)
*D04H 1/46* (2006.01)
*D04H 3/10* (2006.01)

(52) U.S. Cl. ..... 442/408; 442/401; 442/402; 442/403; 442/405; 442/413

(58) Field of Classification Search ..... 442/402, 442/403, 405, 408, 413
See application file for complete search history.

(56) References Cited

U.S. PATENT DOCUMENTS

| | | | | |
|---|---|---|---|---|
| 4,775,579 | A * | 10/1988 | Hagy et al. | 442/329 |
| 5,952,251 | A * | 9/1999 | Jackson et al. | 442/340 |
| 6,163,943 | A | 12/2000 | Johansson et al. | |
| 6,314,627 | B1 * | 11/2001 | Ngai | 28/104 |
| 6,592,713 | B2 | 7/2003 | Ahoniemi | |
| 6,903,034 | B1 | 6/2005 | Putnam et al. | |

FOREIGN PATENT DOCUMENTS

| | | |
|---|---|---|
| EP | 0 308 320 | 3/1989 |
| EP | 0 333 211 | 9/1989 |
| EP | 0 333 212 | 9/1989 |
| EP | 0 333 228 | 9/1989 |
| WO | WO 02/38846 | 5/2002 |

* cited by examiner

*Primary Examiner*—Jenna-Leigh Johnson
(74) *Attorney, Agent, or Firm*—Young & Thompson

(57) ABSTRACT

An improved hydroentangled well integrated composite nonwoven material, including a mixture of continuous filaments, synthetic staple fibers, and natural fibers which has a reduced twosidedness and an improved textile feeling. The synthetic staple fibers should have a length of 3 to 7 mm, and preferably there should be no thermal bondings between the filaments. The method of producing such a nonwoven material is also disclosed. The nonwoven includes a mixture of 10-50 w-% continuous filaments preferably chosen from polypropylene, polyesters and polylactides, 5-50 w-% synthetic staple fibers chosen from polyethylene, polypropylene, polyesters, polyamides, polylactides, rayon, and lyocell, and 20-85 w-% natural fibers, preferably pulp.

13 Claims, 2 Drawing Sheets

HYDROENTANGLED NONWOVEN MATERIAL

CROSS-REFERENCE TO RELATED APPLICATION

This application claims the 35 USC 119(e) benefit of prior U.S. Provisional Application No. 60/515,639 filed on 31 Oct. 2003.

FIELD OF THE INVENTION

The present invention refers to a hydroentangled well integrated composite nonwoven material, comprising a mixture of continuous filaments, synthetic staple fibres, and natural fibres.

BACKGROUND OF THE INVENTION

Absorbing nonwoven materials are often used for wiping spills and leakages of all kinds in industrial, service, office and home locations. The basic synthetic plastic components normally are hydrophobic and will absorb oil, fat and grease, and also to some degree water by capillary force. To reach a higher water absorption level, cellulosic pulp is often added. There are many demands put on nonwoven materials made for wiping purposes. An ideal wiper should be strong, absorbent, abrasion resistant and exhibit low linting. To replace textile wipers, which is still a major part of the market, they should further be soft and have a textile touch.

Nonwoven materials comprising mixtures of cellulosic pulp and synthetic fibres can be produced by conventional papermaking processes, see e.g. U.S. Pat. No. 4,822,452, which describes a fibrous web formed by wetlaying, the web comprising staple length natural or synthetic fibres and wood cellulose paper-making fibres wherein an associative thickener is added in the furnish.

Hydroentangling or spunlacing is a technique introduced during the 1970's, see e.g. CA patent no. 841 938. The method involves forming a fibre web which is either drylaid or wetlaid, after which the fibres are entangled by means of very fine water jets under high pressure. Several rows of water jets are directed against the fibre web which is supported by a movable fabric. The entangled fibre web is then dried. The fibres that are used in the material can be synthetic or regenerated staple fibres, e.g. polyester, polyamide, polypropylene, rayon or the like, pulp fibres or mixtures of pulp fibres and staple fibres. Spunlace materials can be produced in high quality to a reasonable cost and have a high absorption capacity. They can e.g. be used as wiping material for household or industrial use, as disposable materials in medical care and for hygiene purposes etc.

In WO 96/02701 there is disclosed hydroentangling of a foamformed fibrous web. Foamforming is a special variant of wetlaying where the water besides fibres and chemicals also contains a surfactant which makes it possible to create a foam where the fibres can be enmeshed in and between the foam bubbles. The fibres included in the fibrous web can be pulp fibres and other natural fibres and synthetic fibres.

Through e.g. EP-B-0 333 211 and EP-B-0 333 228 it is known to hydroentangle a fibre mixture in which one of the fibre components consists of meltblown fibres which is one type of spunlaid filaments. The base material, i.e. the fibrous material which is exerted to hydroentangling, either consists of at least two combined preformed fibrous layers where at least one of the layers is composed of meltblown fibres, or of a "coform material" where an essentially homogeneous mixture of meltblown fibres and other fibres is airlaid on a forming fabric.

Through EP-A-0 308 320 it is known to bring together a prebonded web of continuous filaments with a separately prebonded wetlaid fibrous material containing pulp fibres and staple fibres and hydroentangle together the separately formed fibrous webs to a laminate. In such a material the fibres of the different fibrous webs will not be integrated with each other since the fibres already prior to the hydroentangling are bonded to each other and only have a very limited mobility. The material will show a marked twosidedness. The staple fibres used have a preferred length of 12 to 19 mm, but could be in the range from 9.5 mm to 51 mm.

One problem is clearly seen in hydroentangled materials—they will very often be markedly twosided, i.e. it can clearly be discerned a difference between the side facing the fabric and the side facing the water jets in the entangling step. In some cases this has been used as a favourable pattern, but in most cases it is seen as a disadvantage. When two separate layers are combined and fed into an entangling process, normally this process step cannot thoroughly mix the layers, but they will still exist, albeit bonded to each other. With pulp in the composite there will be a pulp-rich side and a pulp-poor side, which will result in differing properties of the two sides. This is pronounced when spunlaid filaments are used as they tend to form a flat two-dimensional layer when created, which will mix poorly. Some producers have tried to first add a covering layer and entangle from one side and then turn the web around and add another covering layer and entangle from the other side, but most of the fibre-moving occurs very early in the entangling process, and this more complicated way does not fully solve the problem.

Another problem when using a filament web in a hydroentangled material is that there will be fewer free fibre ends, as the filaments in principle are without ends, and only staple and pulp fibres can contribute to this. Especially polymer fibre ends are what will give the material a textile feeling by their softening effect. The pulp fibres often used in composites will have many free ends but as they engage in hydrogen bonds they will not contribute to a soft textile feeling; instead they will make the resulting material feel much harsher. Thus to get a soft textile material it is important to have a high percentage of textile, i.e. synthetic, staple fibres.

OBJECT AND SUMMARY OF THE INVENTION

It is an object of the present invention to provide an improved hydroentangled well integrated composite nonwoven material, comprising a mixture of continuous filaments, synthetic staple fibres, and natural fibres which has a reduced twosidedness, i.e. both sides should have appearances and properties that are similar.

It is also an object of the present invention to provide an improved hydroentangled well integrated composite nonwoven material, comprising a mixture of continuous filaments, synthetic staple fibres, and natural fibres which has an improved textile feeling.

This has according to the invention been obtained by providing such a hydroentangled nonwoven material where the synthetic staple fibres have a length of 3 to 7 mm.

The choice of shorter staple fibres than has formerly been used enables pulp fibres and staple fibres to be better mixed and distributed thoroughly throughout the nonwoven material.

A preferred material according to the invention has no thermal bondings between the filaments, which will ascertain an initial greater flexibility of movement of the filaments before they have been fully bonded by the hydroentangling, thus allowing the staple and pulp fibres to more fully mix into the filament web.

A preferred material according to the invention comprises a mixture of 10-50% continuous filaments, 5-50% synthetic staple fibres, and 20-85% natural fibres, all percentages calculated by weight of the total nonwoven material. A more preferred material has 15-35% continuous filaments. More preferred is also 5-25% synthetic staple fibres. Also more preferred is 40-75% natural fibres.

A preferred material according to the invention is where the continuous filaments are spunlaid filaments.

A preferred material according to the invention is where the continuous filaments are chosen from the group of polypropylene, polyesters and polylactides.

A preferred material according to the invention is where the basis weight of the continuous filaments web part of the composite is at most 40 g/m$^2$, still more preferably at most 30 g/cm$^2$.

A preferred material according to the invention is where the synthetic staple fibres are chosen from the group of polyethylene, polypropylene, polyesters, polyamides, polylactides, rayon, and lyocell.

A preferred material according to the invention is where at least a part of the synthetic staple fibres are coloured, making up at least 3% of the total weight of the nonwoven, preferably at least 5%.

A preferred material according to the invention is where the natural fibres consist of pulp fibres, more preferably wood pulp fibres.

A preferred material according to the invention is where at least a part of the natural fibres are coloured, making up at least 3% of the total weight of the nonwoven, preferably at least 5%.

Especially when coloured staple or natural fibres are used the reduced twosidedness can very easily be discerned.

The ends of the staple fibres protruding from both sides of the nonwoven material will add an improved textile feeling to the surfaces.

A further object of the invention is to provide a method of producing an improved hydroentangled well integrated composite nonwoven material, comprising a mixture of continuous filaments, synthetic staple fibres, and natural fibres which has a reduced twosidedness, i.e. both sides should have appearances and properties that are similar, and also has an improved textile feeling.

This has according to the invention been obtained by providing a method comprising the steps of forming a web of continuous filaments on a forming fabric, and applying a wet-formed fibre dispersion containing synthetic staple fibres and natural fibres on top of said continuous filaments, thus forming a fibrous web containing said continuous filaments, synthetic staple fibres and natural fibres, and subsequently hydroentangling the fibrous web to form a nonwoven material, where the synthetic staple fibres have a length of 3 to 7 mm, preferably 4 to 6 mm.

A preferred alternative of the inventive method is based on not applying any thermal bonding process step to the continuous filaments.

Other preferred alternatives of the inventive method are based upon using the fibre types, in weight percentages.

BRIEF DESCRIPTION OF THE DRAWINGS

The invention will be closer described below with reference to some embodiments shown in the accompanying drawings.

DETAILED DESCRIPTION OF THE INVENTION

Figure 1:
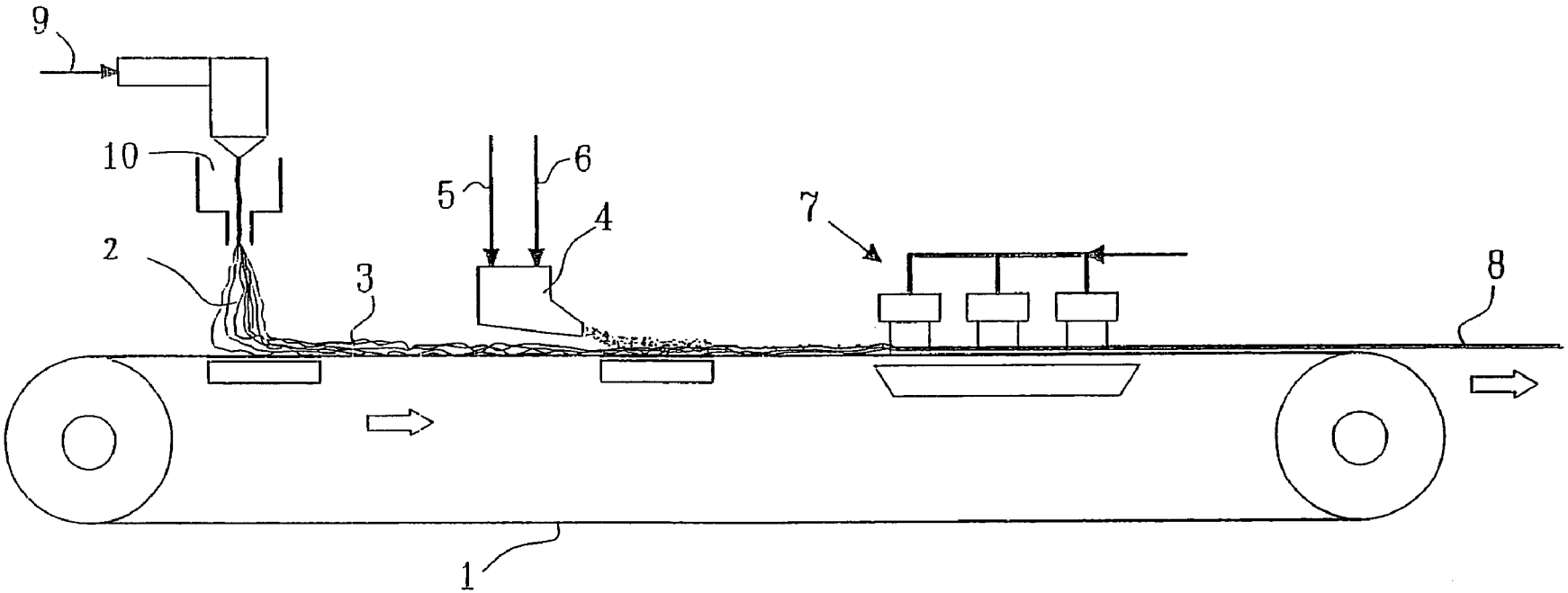
FIG. 1 shows schematically an exemplary embodiment of a device for producing a hydroentangled nonwoven material according to the invention.

The improved hydroentangled well integrated composite nonwoven material comprises a mixture of continuous filaments, synthetic staple fibres, and natural fibres. These different types of fibres are defined as follows.

Filaments

Filaments are fibres that in proportion to their diameter are very long, in principle endless. They can be produced by melting and extruding a thermoplastic polymer through fine nozzles, whereafter the polymer will be cooled, preferably by the action of an air flow blown at and along the polymer streams, and solidified into strands that can be treated by drawing, stretching or crimping. Chemicals for additional functions can be added to the surface.

Filaments can also be produced by chemical reaction of a solution of fibre-forming reactants entering a reagence medium, e.g. by spinning of viscose fibres from a cellulose xanthate solution into sulphuric acid.

Meltblown filaments are produced by extruding. molten thermoplastic polymer through fine nozzles in very fine streams and directing converging air flows towards the polymers streams so that they are drawn out into continuous filaments with a very small diameter. Production of meltblown is e.g. described in U.S. Pat. Nos. 3,849,241 or 4,048,364. The fibres can be microfibres or macrofibres depending on their dimensions. Microfibres have a diameter of up to 20 μm, usually 2-12 μm. Macrofibres have a diameter of over 20 μm, usually 20-100 μm.

Spunbond filaments are produced in a similar way, but the air flows are cooler and the stretching of the filaments is done by air to get an appropriate diameter. The fibre diameter is usually above 10 μm, usually 10-100 μm. Production of spunbond is e.g. described in U.S. Pat. Nos. 4,813,864 or 5,545,371.

Spunbond and meltblown filaments are as a group called spunlaid filaments, meaning that they are directly, in situ, laid down on a moving surface to form a web, that further on in the process is bonded. Controlling the 'melt flow index' by choice of polymers and temperature profile is an essential part of controlling the extruding and thereby the filament formation. The spunbond filaments normally are stronger and more even.

Tow is another source of filaments, which normally is a precursor in the production of staple fibres, but also is sold and used as a product of its own. In the same way as with spunlaid fibres, fine polymer streams are drawn out and stretched, but instead of being laid down on a moving surface to form a web, they are kept in a bundle to finalize drawing and stretching. When staple fibres are produced, this bundle of filaments is then treated with spin finish chemicals, normally crimped and then fed into a cutting stage where a wheel with knives will cut the filaments into distinct fibre lengths that are packed into bales to be shipped and used as staple fibres. When tow is produced, the filament bundles are packed, with or without spin finish chemicals, into bales or boxes.

Any thermoplastic polymer, that has enough coherent properties to let itself be drawn out in this way in the molten state, can in principle be used for producing meltblown or spunbond fibres. Examples of useful polymers are polyolefines, such as polyethylene and polypropylene, polyamides, polyesters and polylactides. Copolymers of these polymers may of course also be used, as well as natural polymers with thermoplastic properties.

Natural Fibres

There are many types of natural fibres that can be used, especially those that have a capacity to absorb water and tendency to help in creating a coherent sheet. Among the natural fibres possible to use there are primarily the cellulosic fibres such as seed hair fibres, e.g. cotton, kapok, and milkweed; leaf fibres e.g. sisal, abaca, pineapple, and New Zealand hamp; or bast fibres e.g. flax, hemp, jute, kenaf, and pulp.

Wood pulp fibres are especially well suited to use, and both softwood fibres and hardwood fibres are suitable, and also recycled fibres can be used.

The pulp fibre lengths will vary from around 3 mm for softwood fibres and around 1.2 mm for hardwood fibres and a mix of these lengths, and even shorter, for recycled fibres.

Staple Fibres

The staple fibres used can be produced from the same substances and by the same processes as the filaments discussed above. Other usable staple fibres are those made from regenerated cellulose such as viscose and lyocell.

They can be treated with spin finish and crimped, but this is not necessary for the type of processes preferably used to produce the material described in the present invention. Spin finish and crimp is normally added to ease the handling of the fibres in a dry process, e.g. a card, and/or to give certain properties, eg hydrophilicity, to a material consisting only of these fibres, eg a nonwoven topsheet for a diaper.

The cutting of the fibre bundle normally is done to result in a single cut length, which can be altered by varying the distances between the knives of the cutting wheel. Depending on the planned use different fibre lengths are used, between 25-50 mm for a thermobond nonwoven. Wetlaid hydroentangled nonwovens normally use 12-18 mm, or down to 9 mm.

For hydroentangled materials made by traditional wetlaid technology, the strength of the material and its properties like surface abrasion resistance are increased as a function of the fibre length (for the same thickness and polymer of the fibre).

When continuous filaments are used together with staple fibres and pulp, the strength of the material will mostly come from the filaments.

Process

One general example of a method for producing the material according to the present invention is shown in FIG. 1 and comprises the steps of:

providing an endless forming fabric 1, where the continuous filaments 2 can be laid down, and excess air be sucked off through the forming fabric, to form the precursor of a web 3;

advancing the forming fabric with the continuous filaments to a wetlaying stage 4, where a slurry comprising a mixture of natural fibres 5 and staple fibres 6 is wetlaid on and partly into the precursor web of continuous filaments, and excess water is drained off through the forming fabric;

advancing the forming fabric with the filaments and fibre mixture to a hydroentangling stage 7, where the filaments and fibres are mixed intimately together and bonded into a nonwoven web 8 by the action of many thin jets of high-pressure water impinging on the fibres to mix and entangle them with each other, and entangling water is drained off through the forming fabric;

advancing the forming fabric to a drying stage (not shown) where the nonwoven web is dried;

and further advancing the nonwoven web to stages for rolling, cutting, packing, etc.

Filament 'Web'

According to the embodiment shown in FIG. 1 the continuous filaments 2 made from extruded molten thermoplastic pellets are laid down directly on a forming fabric 1 where they are allowed to form an unbonded web structure 3 in which the filaments can move relatively freely from each other. This is achieved preferably by making the distance between the nozzles and the forming fabric 1 relatively large, so that the filaments are allowed to cool down before they land on the forming fabric, at which lower temperature their stickiness is largely reduced. Alternatively cooling of the filaments before they are laid on the forming fabric is achieved in some other way, e.g. by means of using multiple air sources where air 10 is used to cool the filaments when they have been drawn out or stretched to the preferred degree.

The air used for cooling, drawing and stretching the filaments is sucked through the forming fabric, to let the filaments follow the air flow into the meshes of the forming fabric to be stayed there. A good vacuum might be needed to suck off the air.

The speed of the filaments as they are laid down on the forming fabric is much higher than the speed of the forming fabric, so the filaments will form irregular loops and bends as they are collected on the forming fabric to form a very randomized precursor web.

The basis weight of the formed filament precursor web 3 should be between 2 and 50 g/m$^2$.

Wet-Laying

The pulp 5 and staple fibres 6 are slurried in conventional way, either mixed together or first separately slurried and then mixed, and conventional papermaking additives such as wet and/or dry strength agents, retention aids, dispersing agents, are added, to produce a well mixed slurry of pulp and staple fibres in water.

This mixture is pumped out through a wet-laying headbox 4 onto the moving forming fabric 1 where it is laid down on the unbonded precursor filament web 3 with its freely moving filaments.

The pulp and the staple fibres will stay on the forming fabric and the filaments. Some of the fibres will enter between the filaments, but the vast majority of them will stay on top of the filament web.

The excess water is sucked through the web of filaments laid on the forming fabric and down through the forming fabric, by means of suction boxes arranged under the forming fabric.

Entangling

The fibrous web of continuous filaments and staple fibres and pulp is hydroentangled while it is still supported by the forming fabric and is intensely mixed and bonded into a composite nonwoven material 8. An instructive description of the hydroentangling process is given in CA patent no. 841 938.

In the hydroentangling stage 7 the different fibre types will be entangled and a composite nonwoven material 8 is obtained in which all fibre types are substantially homogeneously mixed and integrated with each other. The fine mobile spunlaid filaments are twisted around and entangled with themselves and the other fibres, which gives a material with a very high strength. The energy supply needed for the hydroentangling is relatively low, i.e. the material is easy to entangle. The energy supply at the hydroentangling is appropriately in the interval 50-500 kWh/ton.

Preferably, no bonding, by e.g. thermal bonding or hydroentangling, of the precursor filament web 3 should occur before the pulp 5 and staple fibres 6 are laid down 4. The filaments should be completely free to move in respect of each other to enable the staple and pulp fibres to mix and twirl into the filament web during entangling. Thermal bonding points between filaments in the filament web at this part of the process would act as blockings to stop the staple and pulp fibres to enmesh near these bonding points, as they would keep the filaments immobile in the vicinity of the thermal bonding points. The 'sieve effect' of the web would be enhanced and a more two-sided material would be the result. By no thermal bondings we mean that there are substantially no points where the filaments have been excerted to heat and pressure, e.g. between heated rollers, to render some of the filaments pressed together such that they will be softened and/or melted together to deformation in points of contact. Some bond points could especially for meltblown result from residual tackiness at the moment of laying-down, but these will be without deformation in the points of contact, and would probably be so weak as to break up under the influence of the force from the hydroentangling water jets.

The strength of a hydroentangled material based on only staple and pulp will depend heavily on the amount of entangling points for each fibre; thus long staple fibres, and long pulp fibres, are preferred. When filaments are used, the strength will be based mostly on the filaments, and reached fairly quickly in the entangling. Thus most of the entangling energy will be spent on mixing filaments and fibres to reach a good integration. The unbonded open structure of the filaments according to the invention will greatly enhance the ease of this mixing.

The pulp fibres 5 are irregular, flat, twisted and curly and gets pliable when wet. These properties will let them fairly easily be mixed and entangled into and also stuck in a web of filaments, and/or longer staple fibres. Thus pulp can be used with a filament web that is prebonded, even a prebonded web that can be treated as a normal web by rolling and unrolling operations, even if it still does not have the final strength to its use as a wiping material.

The polymer fibres 6, though, are mostly round, even, of constant diameter and slippery, and are not effected by water. This makes them harder to entangle and force down into a prebonded filament web, they will tend to stay on top. To get enough entangling bonding points to catch the polymer fibres securely in the filament web, a fairly long staple fibre is needed. Thus mostly staple fibres of 12-18 mm, at most down to 9 mm, have earlier been described together with filament webs, which all have been prebonded.

By the inventive method in this application it is possible to use the much greater flexibility of an unbonded filament web to ease the entraining of polymer staple fibres and thus use much shorter such fibres. They can be in the range of 2 to 8 mm, preferably 3 to 7 mm, even more preferably 4 to 6 mm.

The entangling stage 7 can include several transverse bars with rows of nozzles from which very fine water jets under very high pressure are directed against the fibrous web to provide an entangling of the fibres. The water jet pressure can then be adapted to have a certain pressure profile with different pressures in the different rows of nozzles.

Alternatively, the fibrous web can before hydroentangling be transferred to a second entangling fabric. In this case the web can also prior to the transfer be hydroentangled by a first hydroentangling station with one or more bars with rows of nozzles.

Drying etc

The hydroentangled wet web 8 is then dried, which can be done on conventional web drying equipment, preferably of the types used for tissue drying, such as through-air drying or Yankee drying. The material is after drying normally wound into mother rolls before converting.

The material is then converted in known ways to suitable formats and packed.

The structure of the material can be changed by further processing such as microcreping, hot calandering, embossing, etc. To the material can also be added different additives such as wet strength agents, binder chemicals, latexes, debonders, etc.

Nonwoven Material

A composite nonwoven according to the invention can be produced with a total basis weight of 20-120 g/m$^2$, preferably 50-80 g/m$^2$.

The unbonded filaments will improve the mixing-in of the staple fibres, such that even a short fibre will have enough entangled bonding points to keep it securely in the web. The shorter staple fibres will then result in an improved material as they have more fibre ends per gram fibre and are easier to move in the Z-direction (perpendicular to web plane). More fibre ends will project from the surface of the web, thus enhancing the textile feeling.

The secure bonding will result in very good resistance to abrasion.

As can be seen from the examples the staple fibres can be a mixture of fibres based on different polymers, with different lengths and dtex, and with different colours.

It is also contemplated to add a certain proportion of synthetic staple fibres longer than 7 mm and even longer than 12 mm to the composite nonwoven. This certain proportion could be up to 10% of the amount of synthetic staple fibres shorter than 7 mm, based on weight portions. No specific advantages are however seen by this addition. It will predominantly add to the strength of the nonwoven, but the strength is more easily adjusted by the amount of filaments.

The invention is of course not limited to the embodiments shown in the drawings and described above and in the examples but can be further modified within the scope of the claims.

EXAMPLES

A number of hydroentangled materials according to the invention with different fibre compositions were produced and tested with respect to interesting parameters.

Specific Tests Used:

Taber—A material to be tested is fastened on a plate and abrasive wheels are made to run in a circle upon it, according to ASTM D 3884-92, with some modifications caused by measuring a thin, non-permanent material, and not floor carpets as the method was originally designed for. The modifications consist of using wheels Calibrase CS-10, but with no extra weights added, and only 200 revolutions are made. The resulting abrasion wear is compared to an internal standard, where 1 means 'abraded to shreds' and 5 means 'not visibly affected'. The apparatus used was of the type '5151 Abraser' from Taber Industries, N. Tonawanda, N.Y., USA.

L* lightness and b* colour—The material to be tested is illuminated by 'outdoor daylight' and measurements are taken with a Technidyne, Color Touch model instrument calorimeter, from Technidyne, New Albany, Ind., USA.

CIE L* a* b* Color Space L* (lightness) and b* (blueness) values of the test material are measured according to the Cielab 1976 system, corresponding to the CIE standard illuminant D65, described in ISO 10526 and the CIE 1964 supplementary standard calorimetric observer, described in ISO/CIE 10527, determined by measurement under the conditions analogous to those specified in ISO 5631.

This is a system for the description and specification of colour based upon corrections from the measured calorimetric values to the human perception of a so-called 'Standard observer'.

The measured CIE tristimulus values are transformed into CIE L* and b* values by the following equations, where Y and Z (values from the calorimeter) are expressed in percent:

$$L^*=116\cdot(Y/100)^{1/3}-16$$

$$b^*=200\cdot[(Y/100)^{1/3}-(Z/118.232)^{1/3}]$$

The method is further described in a booklet, 'Measurement and Control of the Optical Properties of Paper', 2nd edition, from Technidyne Corporation, 1996.

These tests were made on nonwoven samples according to the invention and on reference samples, where the two sides of the samples are designated fabric side, meaning the side of the nonwoven which has been against the forming fabric when the filaments, staple fibres and pulp have been laid down, and the free side, meaning the side of the nonwoven from which the different fibres have been laid down.

Example 1

A 0.4 m wide web of spunlaid filaments was laid down onto a forming fabric at 20 m/min such that the filaments were not bonded to each other. The unbonded web of spunlaid filaments was slightly compacted and transferred to a second forming fabric for addition of the wet-laid components. By a 0.4 m wide headbox a fibre dispersion containing pulp fibres and shortcut staple fibres was laid onto the unbonded web of spunlaid filaments and the excess water was drained and sucked off.

The unbonded spunlaid filaments and wetlaid fibres were then mixed and bonded together by hydroentanglement with three manifolds at a pressure of 7.0 kN/m$^2$. The hydroentanglement was done from the free side and the pulp and staple fibres were thus moved into and mixed intensively with the spunlaid filament web. The energy supplied at the hydroentanglement was 300 kWh/ton.

Finally the hydroentangled material was dewatered and then dried using a through-air drum drier.

The total basis weight of the spunlaid filament-staple-pulp composite was around 80 g/m$^2$. The composition of the composite material was 25% spunlaid polypropylene filaments, 10% shortcut polypropylene staple fibres and 65% chemical pulp. The titre of the spunlaid filaments was measured by a scanning electron microscope and found to be 2.3 dtex. Composite materials were made with shortcut staple PP fibres of 1.7 dtex with different lengths of 6, 12 and 18 mm respectively.

Figure 2:
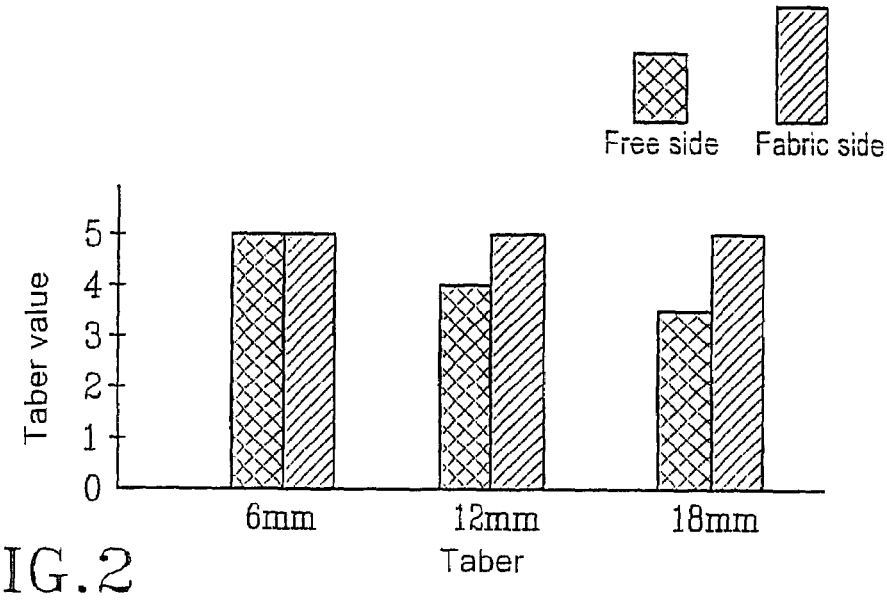
FIG. 2 shows in the form of a staple diagram abrasion wear resistance for both sides for three composites with different staple fibre lengths.

The surface abrasion wear resistance strength measured by the Taber abrasion wear test on the free side, see FIG. 2, indicates that material made with 6 mm fibres is better, especially on the free side, which is turned away from the forming fabric, than corresponding materials made with 12 and 18 mm shortcut staple fibres.

Example 2

The set-up of Example 1 was repeated with blue coloured shortcut polypropylene staple fibres to study the mixing/integration of the staple fibres with the continuous spunlaid filaments and the pulp depending on the staple fibre length. The total basis weight of the composite material was around 80 g/m$^2$ and the composition was 25% spunlaid filaments, 10% shortcut staple fibres and 65% chemical pulp. The titre of the spunlaid filaments was 2.3 dtex. The lengths of the blue shortcut 1.7 dtex PP staple fibres were 6 and 18 mm respectively.

Figure 3:
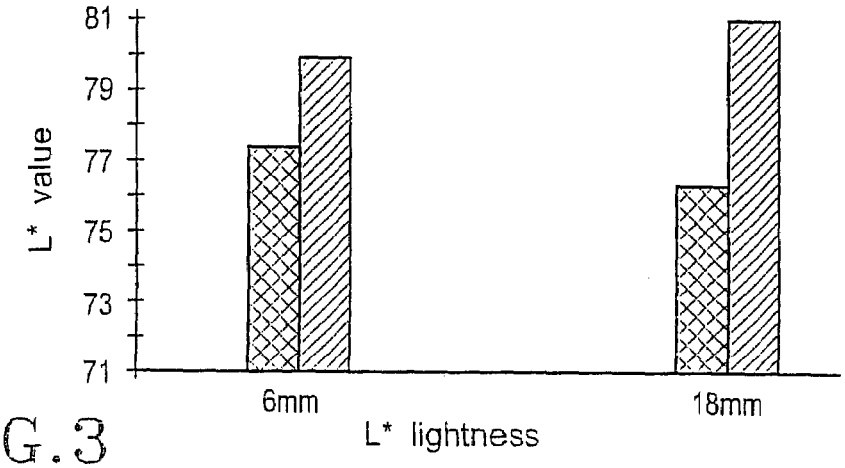
FIG. 3 shows in the form of a staple diagram L* Lightness values for both sides of two composites with different staple fibre lengths.
Figure 4:
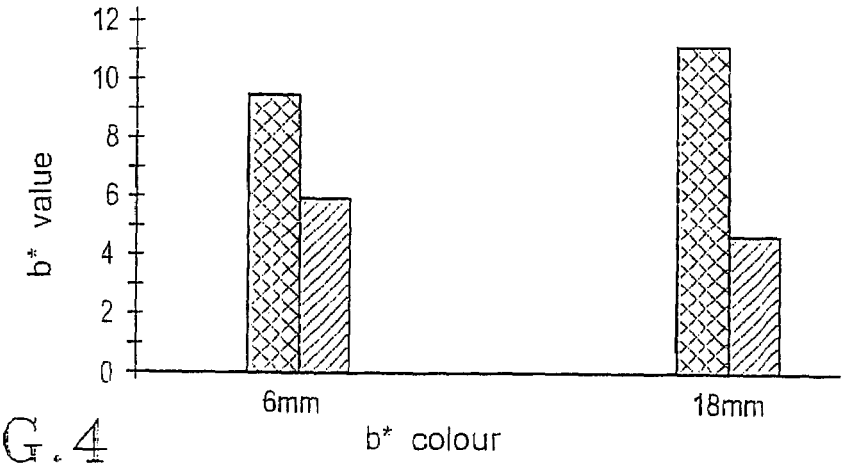
FIG. 4 shows in the form of a staple diagram B* colour values for both sides of two composites with different staple fibre lengths.

When the materials were observed visually it was obvious that the free side initially containing the 10% blue coloured staple fibres was more blue (or darker) compared to the fabric side. The lightness and colour of the materials were characterised using a Technidyne, Color Touch model instrument. As shown by the L*-Lightness values in FIG. 3 the fabric side was always lighter compared to the free side—more coloured fibres stayed on the side where they were laid down. As the results for the composites made with the 6 mm fibre compared to the results obtained with the 18 mm fibres show, the difference between the two sides was smaller for the 6 mm long fibres—indicating that the shorter fibres had easier to migrate to the other side. As the B* colour values were evaluated by the instrument a similar result, as seen in FIG. 4, was obtained that showed that the colour difference between the two sides was smaller when the 6 mm long fibres was used instead of the 18 mm long fibres, which also indicates that the shorter fibres had easier to migrate to the other side.

These results thus support that a shorter staple fibre will be better integrated with the continuous unbonded spunlaid filament network.

Example 3

The set-up of Example 1 was repeated with shortcut rayon staple fibres to study the mixing/integration of rayon staple fibres with the continuous spunlaid filaments and the pulp compared to polypropylene staple fibres. The total basis weight of the composite material was around 47 g/m$^2$ and the composition was 25% spunlaid filaments, 10% shortcut rayon staple fibres and 65% chemical pulp.

The shortcut rayon staple fibres were 1.7 dtex and had a length of 6 mm.

The web was entangled by an entangling energy of 400 kWh/ton.

Example 4

The set-up of Example 1 was repeated with black coloured shortcut polypropylene staple fibres to study the mixing/integration of the staple fibres with the continuous spunlaid filaments and the pulp depending on the staple fibre length. The total basis weight of the composite material was around 68 g/m$^2$ and the composition was 25% spunlaid filaments, 10% shortcut staple fibres and 65% pulp.

The black shortcut PP staple fibres were 1.7 dtex and had a length of 6 mm.

The web was entangled by an entangling energy of 400 kWh/ton.

Example 5

The set-up of Example 1 was repeated with blue coloured shortcut rayon staple fibres and white shortcut polypropylene staple fibres to study the mixing/integration of the staple fibres with the continuous spunlaid filaments and the pulp. The total basis weight of the composite material was around 80 g/m$^2$ and the composition was 25% spunlaid filaments, 5% shortcut blue rayon staple fibres, 5% shortcut white polypropylene staple fibres and 65% pulp.

The blue shortcut rayon staple fibres were 1.7 dtex and had a length of 6 mm. The white shortcut PP staple fibres were 1.2 dtex and had a length of 6 mm.

The web was entangled by an entangling energy of 300 kWh/ton, transferred to a patterning fabric and patterned by an entangling energy of 135 kWh/ton.

The mechanical properties of Examples 3 to 5 are shown in Table 1. The properties are satisfactory and show that the reduced two-sidedness and better abrasion resistance can be achieved without sacrificing other properties.

TABLE 1

| Example | 3 | 4 | 5 |
|---|---|---|---|
| Entangling energy (kWh) | 400 | 400 | 300 + 135 |
| Basis weight (g/m$^2$) | 47.1 | 68.2 | 79.8 |
| Thickness 2 kPa (μm) | 339 | 421 | 478 |
| Bulk 2 kPa (cm$^3$/g) | 7.2 | 6.2 | 6.0 |
| Tensile stiffness MD (N/m) | 10901 | 27429 | 31090 |
| Tensile stiffliess CD (N/m) | 1214 | 2237 | 2727 |
| Tensile strength dry MD (N/m) | 934 | 1694 | 1989 |
| Tensile strength dry CD (N/m) | 533 | 933 | 1059 |
| Elongation MD (%) | 115 | 49 | 45 |
| Elongation CD (%) | 156 | 131 | 119 |
| Work to rupture MD (J/m$^2$) | 1022 | 905 | 1028 |
| Work to rupture CD (J/m$^2$) | 589 | 817 | 876 |
| Work to rupture index (J/g) | 16.5 | 12.6 | 11.9 |
| Tensile strength MD, wet (N/m) | | 1647 | |
| Tensile strength CD, wet (N/m) | | 832 | |

The invention claimed is:

1. A hydroentangled well integrated composite nonwoven material, comprising:

continuous filaments;

wet laid natural fibres; and wet laid synthetic staple fibres, wherein, the synthetic staple fibres have a length of 3 to 7 mm, each continuous filament is free of thermal bonding points with any other continuous filament, and the continuous filaments, the natural fibres, and the synthetic staple fibres are hydroentangled so that the continuous filaments, the natural fibres, and the synthetic staple fibres are well integrated throughout the composite nonwoven material and each continuous filament is twisted around and entangled with other continuous filaments and with the natural fibres and the synthetic staple fibres.

2. The hydroentangled nonwoven material according to claim 1, wherein the mixture is made up of 10-50%, continuous filaments, 20-85%, natural fibres, and 5-50%, synthetic staple fibres, all percentages calculated by weight of the total nonwoven material.

3. The hydroentangled nonwoven material according to claim 1, wherein the continuous filaments are spunlaid filaments.

4. The hydroentangled nonwoven material according to claim 3, wherein the continuous filaments are selected from the group consisting of polypropylene, polyesters, and polylactides.

5. The hydroentangled nonwoven material according to claim 1, wherein the continuous filaments web part of the composite has a basis weight of at most 40 g/m$^2$.

6. A hydroentangled nonwoven material according to claim 1, wherein the synthetic staple fibres have a length of 4 to 6 mm, and are selected from the group consisting of polyethylene, polypropylene, polyesters, polyamides, polylactides, rayon, and lyocell.

7. The hydroentangled nonwoven material according to claim 1, wherein a part of the synthetic staple fibres are coloured, making up at least 3% of the total weight of the nonwoven.

8. The hydroentangled nonwoven material according to claim 1, wherein the natural fibres comprise pulp fibres.

9. The hydroentangled nonwoven material according to claim 1, wherein a part of the natural fibres are coloured, making up at least 3% of the total weight of the nonwoven.

10. The hydroentangled nonwoven material according to claim 2, wherein the mixture is made up of 15-35%, continuous filaments, 40-75 %, natural fibres, and 5-25%, synthetic staple fibres, all percentages calculated by weight of the total nonwoven material.

11. The hydroentangled nonwoven material according to claim 7, wherein a part of the synthetic staple fibres are coloured, making up at least 5% of the total weight of the nonwoven.

12. The hydroentangled nonwoven material according to claim 1, wherein a part of the natural fibres are coloured, making up at least 5% of the total weight of the nonwoven.

13. The hydroentangled nonwoven material according to claim 1, wherein the natural fibres consist of wood pulp fibres.

* * * * *